US007834610B2

(12) United States Patent
Peng et al.

(10) Patent No.: US 7,834,610 B2
(45) Date of Patent: Nov. 16, 2010

(54) BANDGAP REFERENCE CIRCUIT

(75) Inventors: Yan-Hua Peng, Miaoli County (TW); Uei-Shan Uang, Taichung County (TW); Mei-Show Chen, Hsinchu (TW)

(73) Assignee: Faraday Technology Corp., Science-Based Industrial Park, Hsin-Chu (TW)

( * ) Notice: Subject to any disclaimer, the term of this patent is extended or adjusted under 35 U.S.C. 154(b) by 623 days.

(21) Appl. No.: 11/756,859

(22) Filed: Jun. 1, 2007

(65) Prior Publication Data

US 2008/0297131 A1 Dec. 4, 2008

(51) Int. Cl.
*G05F 3/16* (2006.01)

(52) U.S. Cl. ..... 323/313; 323/316

(58) Field of Classification Search ..... 323/312–317
See application file for complete search history.

(56) References Cited

U.S. PATENT DOCUMENTS 5,519,310 A * 5/1996 Bartlett ..... 323/316
5,686,823 A * 11/1997 Rapp ..... 323/313
6,046,578 A * 4/2000 Feldtkeller ..... 323/314
2005/0093531 A1* 5/2005 Vorenkamp et al. ..... 323/316
2007/0052404 A1* 3/2007 Richardson ..... 323/316

OTHER PUBLICATIONS

Article titled "A CMOS Bandgap reference Circuit with sub-1-V Operation" jointly authored by H. Banba et al. IEEE Journal of Solid-State Circuits, vol. 34,No. 5, pp. 670-674, May 1999.

* cited by examiner

*Primary Examiner*—Jessica Han
(74) *Attorney, Agent, or Firm*—Winston Hsu; Scott Margo

(57) ABSTRACT

A bandgap reference circuit includes a reference current generator for respectively generating a first reference current on a first current path and a second reference current on a second current path, a current mirror for generating a third reference current on a third current path based on the first and second reference currents, an operation amplifier for rendering the first reference current substantially identical to the second reference current and a feedback circuit for rendering a node voltage on the first current path substantially identical to another node voltage on the third current path, so as to eliminate possible errors caused by a channel length modulation effect in the current mirror.

18 Claims, 12 Drawing Sheets

BANDGAP REFERENCE CIRCUIT

BACKGROUND OF THE INVENTION

1. Field of the Invention

The present invention generally relates to an improved bandgap reference circuit capable of improving the electrical characteristic of power supply rejection ratio (PSRR) and temperature coefficient (TC) thereof.

2. Description of Related Art

For a digital-to-analog converter (DAC), an analog-to-digital converter (ADC) or a regulator, at least a fixed and stable reference voltage is required to the operation thereof. The reference voltage is preferably to be stably regenerated whenever starting up the power supply. An ideal reference voltage is preferably free from influences of process nonconformance, operation temperature change and power source variance.

It is well known that a bandgap reference circuit is suitable for providing a reference voltage. Thus, in a number of electronic systems, a bandgap reference circuit plays an important role since a bandgap reference circuit would vitally affect the stability and accuracy of the system.

Usually, a bandgap reference circuit includes following major components: a current mirror, an operation amplifier, a bandgap current generator and a load.

FIG. 1 is a schematic drawing of a conventional bandgap reference circuit. The bandgap reference circuit includes MOS transistors (metal oxide semiconductor transistor) M11-M13, an operation amplifier OP1, BJTs (bipolar junction transistors) Q11 and Q12, resistors R11 and R12 to constitute a bandgap current generator and a load R13.

The bandgap current generator in FIG. 1 includes two current paths, through which two currents I1A and I1B generated thereby respectively flow and I1A=I1B=I11+I12. The current I11 herein is a Proportional solute Temperature (PTAT) current, while the current I12 is a Complementary solute Temperature (CTAT) current; therefore, the resulting current I1A or I1B of the currents I11+I12 is regarded as a temperature-independent current. In addition, thanks to the operation of a current mirror, I1C=I1A=I1B; thus, I1C is also regarded as a temperature-independent current. Furthermore, because VREF=I1C*R13, the reference voltage VREF generated by the bandgap current generator is regarded as a temperature-independent current as well.

In consideration of the channel-length-modulation effects of the MOS transistors, I1A=I1B≠I1C. The cause of the unidentical relationship herein is that although an effect of virtual ground (V1A=V1B) results in the drain-source voltages of the MOS transistors M11 and M12 are identical to each other; but another node voltage V1C is not necessarily identical to V1A or V1B. As a result, the drain-source voltages of the MOS transistors M11 and M12 are not necessarily identical to the drain-source voltage of the MOS transistor M13, i.e. $V_{DSM11}=V_{DSM12}\neq V_{DSM13}$. Such mismatch of the drain-source voltages is quite sensitive to the power source and the temperature, which would lead to a poor power supply rejection ratio (PSRR) and an unacceptable temperature coefficient (TC).

Based on the above-described situation, it is highly desirable to improve the conventional bandgap reference circuit to overcome the disadvantages of the prior art, i.e. capable of providing a better temperature coefficient and improving the poor PSRR characteristic. Besides, the improved bandgap reference circuit should be designed without specific circuit components and fabricated by standard CMOS (complementary metal oxide semiconductor transistor) processes.

SUMMARY OF THE INVENTION

Accordingly, the present invention is directed to an improved architecture of bandgap reference circuit serving as a bandgap reference circuit in current mode.

The present invention provides an improved architecture of bandgap reference circuit capable of providing a better temperature coefficient and better PSRR characteristic.

The present invention provides a bandgap reference circuit, which can be operated by a low voltage power source and has low dependency on temperature coefficient and can also be fabricated in CMOS processes.

As embodied and broadly described herein, the present invention provides an improved bandgap reference circuit, which includes a reference current generator for generating a first reference current on a first current path and a second reference current on a second current path, a current mirror for generating a third reference current on a third current path according to the first reference current and the second reference current, a first operation amplifier coupled to the first current path and the second current path so as to render a first node voltage on the first current path identical to a second node voltage on the second current path, a feedback circuit coupled to the first current path and the third current path so as to render the first node voltage substantially identical to a third node voltage on the third current path, and a reference load.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

To render the explanation of the present invention more clear, several embodiments of the present invention are exemplarily described hereinafter.

In order to reduce the possibility of the mismatch of the drain-source voltages of the current mirror's MOS transistors as in the case of the prior art, another operation amplifier is employed according to an embodiment of the present invention such that the drain-source voltages of all the MOS transistors in the current mirror are substantially identical to each other and a circuit error caused by a channel-length-modulation effect can be reduced.

Figure 2:
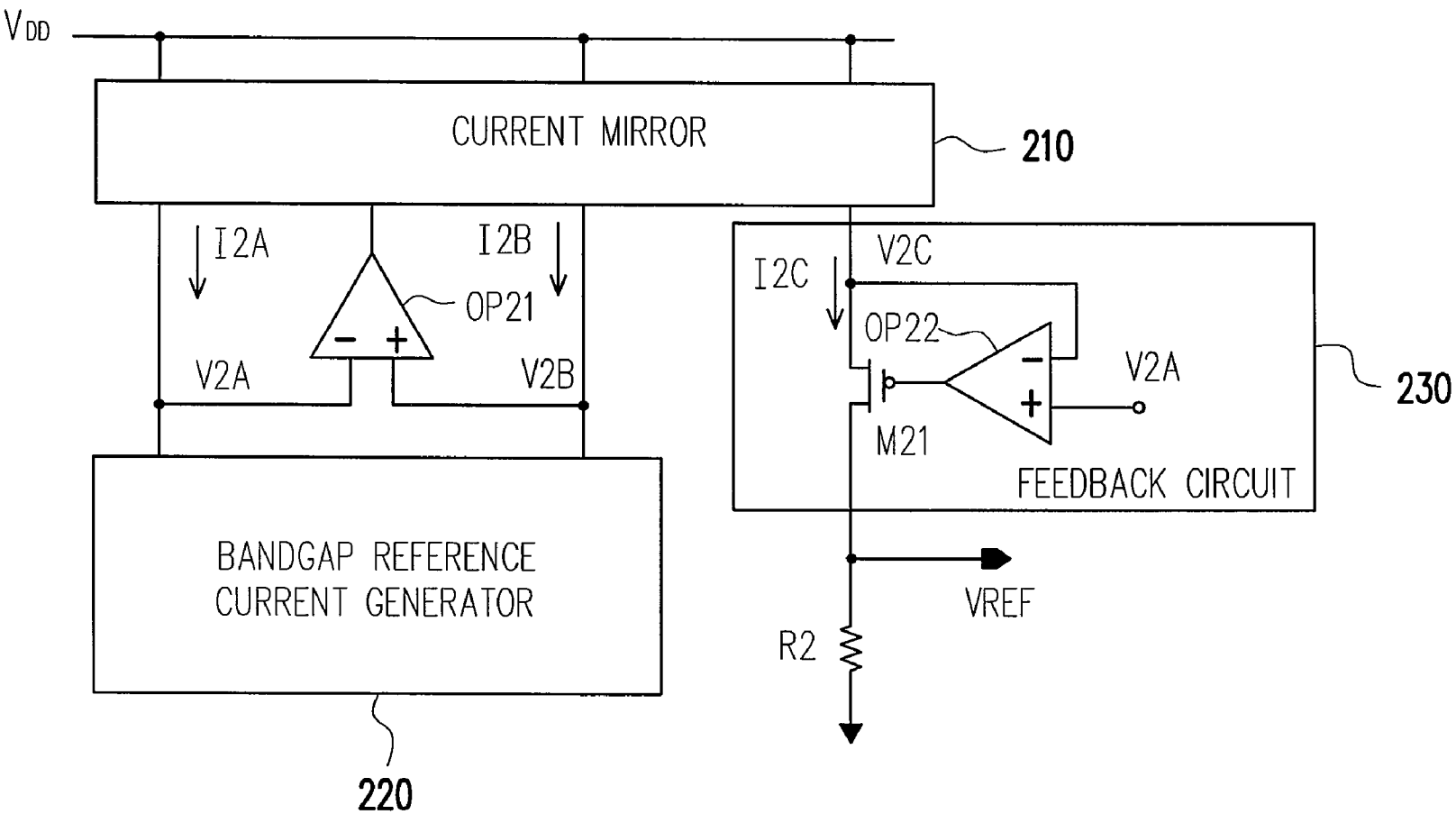
FIG. 2 is a block diagram of a bandgap reference circuit according to a preferred embodiment of the present invention.

FIG. 2 is a block diagram of a bandgap reference circuit according to a preferred embodiment of the present invention. The bandgap reference circuit includes a current mirror 210, an operation amplifier OP21, a bandgap current generator 220, a feedback circuit 230 and a load R2.

The bandgap current generator 220 is adapted for generating temperature-independent currents I2A and I2B, wherein the architecture of the bandgap current generator 220 is not specifically defined, but functions at least to generate a bandgap current. The operation amplifier OP21 enables the node voltages V2A and V2N to be substantially identical to each other.

The current mirror 210 mirrors another temperature-independent current I2C based on the currents I2A and I2B generated by the bandgap current generator 220. Similarly, the architecture of the current mirror 210 is not specifically defined here.

The feedback circuit 230 may render the node voltages V2C=V2A; consequently, all the MOS transistors (not shown) in the current mirror 210 substantially have a same drain-source voltage, and the currents generated by all the MOS transistors in the current mirror 210 are substantially matched with each other by even taking a channel-length-modulation effect into consideration. That is to say once all the MOS transistors for generating currents I2A, I2B and I2C have same sizes, then I2A=I2B=I2C and the currents I2A, I2B and I2C are temperature-independent currents.

The feedback circuit 230 includes, for example, an operation amplifier OP22 and a MOS transistor M21. The positive and negative input terminals of the operation amplifier OP22 are respectively coupled to the nodes V2A and V2C, while the output terminal thereof is coupled to the gate of the MOS transistor M21. The source of the MOS transistor M21 is coupled to the node V2C and the current mirror 210, the gate thereof is coupled to the output terminal of the operation amplifier OP22 and the drain thereof is coupled to the load R2.

FIGS. 3-6 illustrate several, but not limited to, implementations of the present embodiment. The bandgap reference circuit in FIG. 3 includes MOS transistors M31-M33 (to form a current mirror), an operation amplifier OP31, an operation amplifier OP32 and a MOS transistor M34 (to form a feedback circuit), a plurality of current components (for example, BJTs Q31 and Q32), resistors R31 and R32 and a load R33. In addition to BJT, the current components can also be implemented by using diode, MOS transistor operated in subthreshold region or diode turn-on NMOS (DTNMOS).

A negative feedback mechanism of the operation amplifiers OP31 and OP32 enables the node voltages V3A, V3B and V3C to be substantially identical to each other, i.e. V3A=V3B=V3C. In this way, the drain-source voltages of the MOS transistors M31-M33 are substantially identical to each other. At this time, even by taking a channel-length-modulation effect into consideration, the currents I3A, I3B and I3C generated by the MOS transistors M31-M33 are substantially identical to each other as well (assuming the sizes of the MOS transistors M31-M33 are the same).

Figure 4:
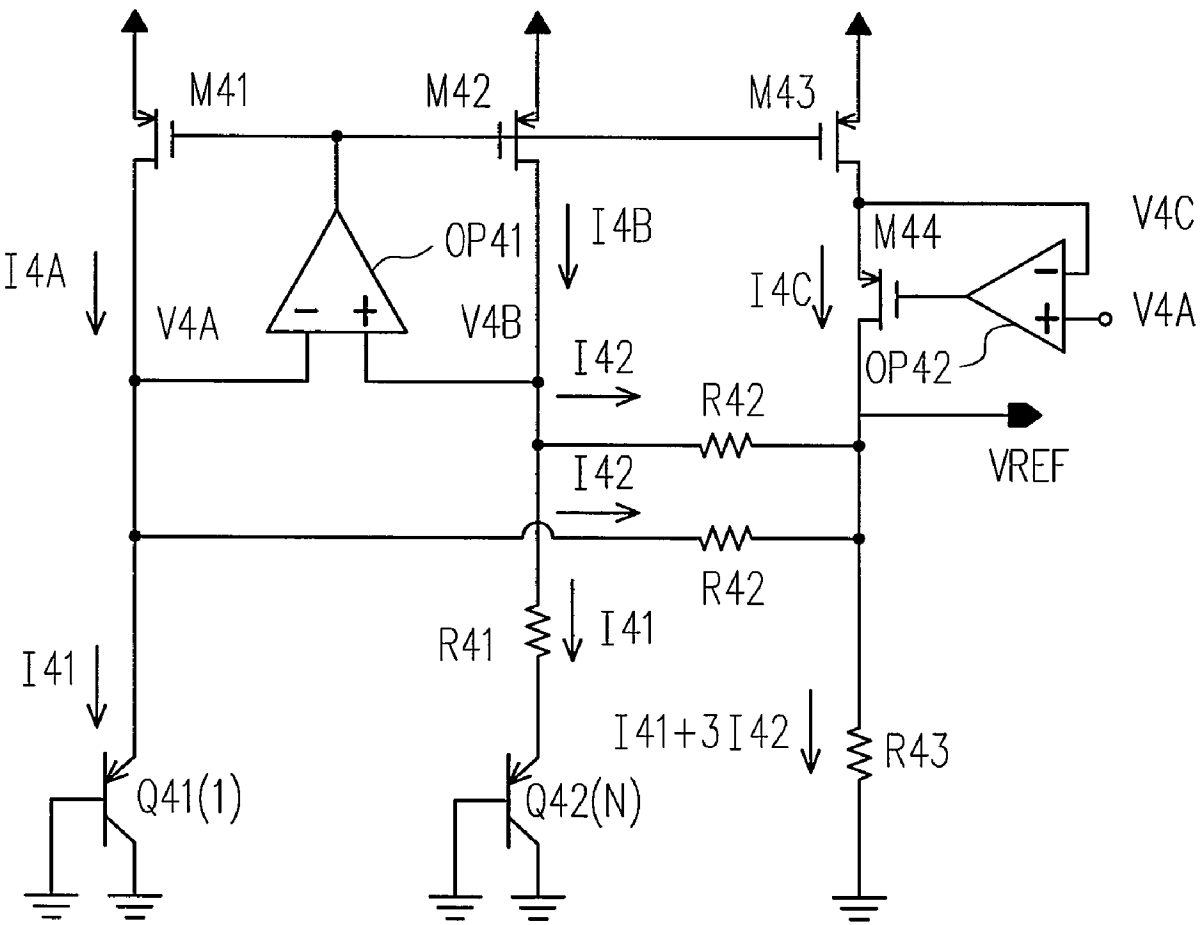

The bandgap reference circuit in FIG. 4 includes MOS transistors M41-M43 (to form a current mirror), an operation amplifier OP41, a MOS transistor M44 and an operation amplifier OP42 (to form a feedback circuit), a plurality of current components (for example, BJTs Q41 and Q42), resistors R41 and R42 and a load R43. In addition to BJT, the current components can also be implemented by using diode, MOS transistor operated in subthreshold region or diode turn-on NMOS (DTNMOS).

Figure 5:
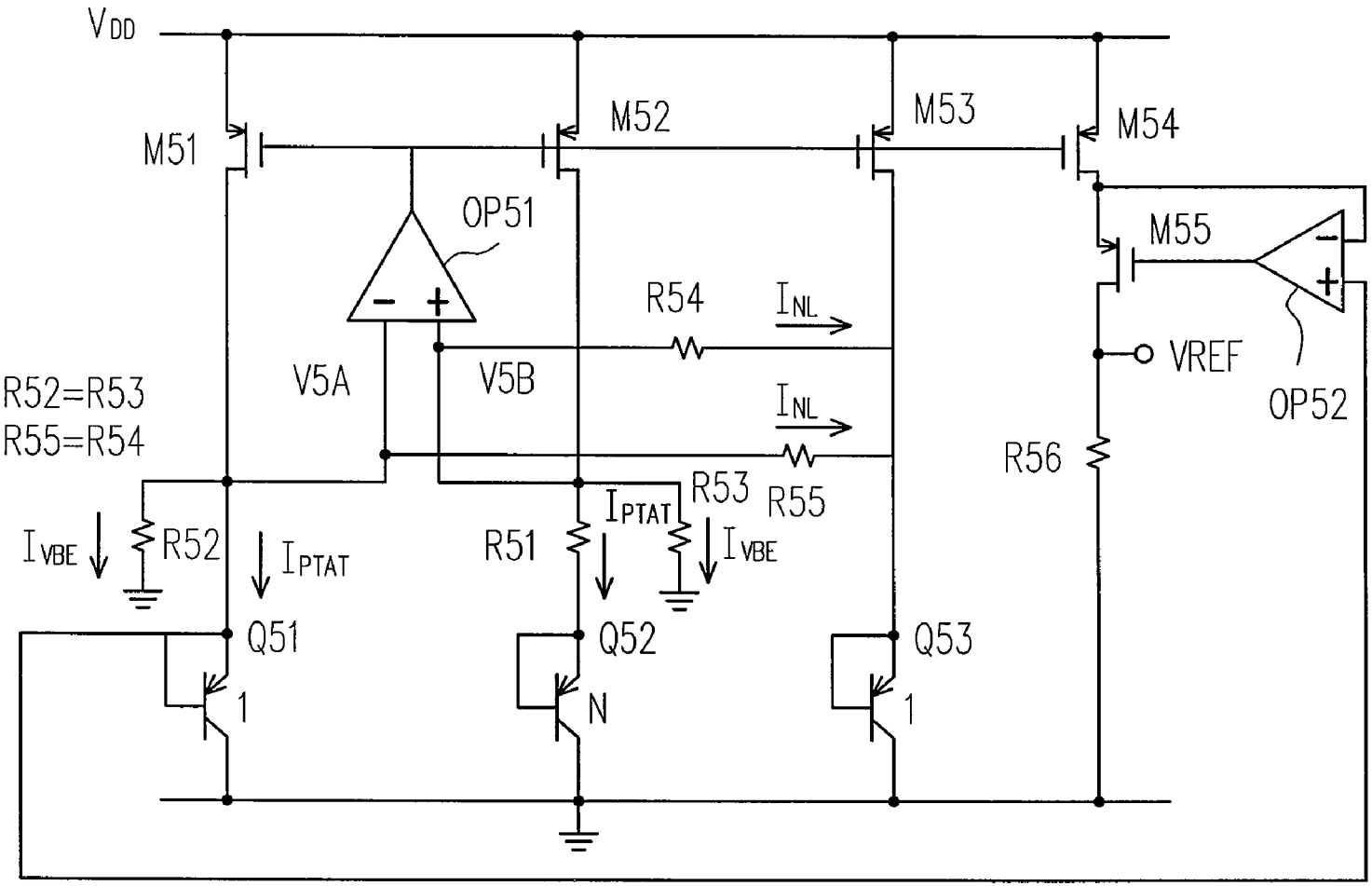

The bandgap reference circuit in FIG. 5 includes MOS transistors M51-M54 (to form a current mirror), an operation amplifier OP51, a MOS transistor M55 and an operation amplifier OP52 (to form a feedback circuit), a plurality of current components (for example, BJTs Q51 and Q53), resistors R51-R55 and a load R56. In addition to BJT, the current components can also be implemented by using diode, MOS transistor operated in subthreshold region or diode turn-on NMOS (DTNMOS).

Figure 6:
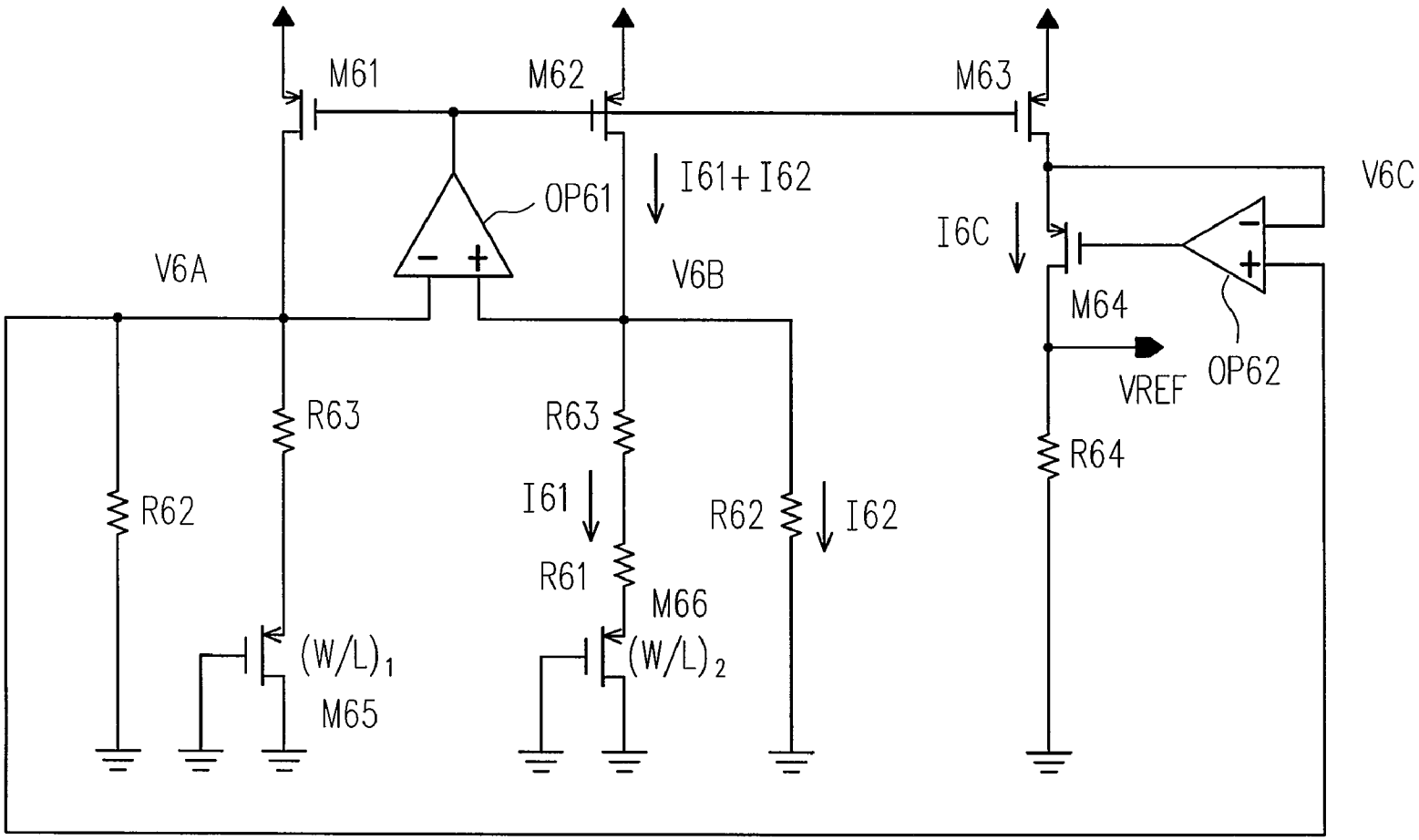

The bandgap reference circuit in FIG. 6 includes MOS transistors M61-M63 (to form a current mirror), an operation amplifier OP61, a MOS transistor M64 and an operation amplifier OP62 (to form a feedback circuit), a plurality of current components (for example, MOS transistors M65-M66 operated in subthreshold region), resistors R61-R63 and a load R64. In addition to MOS transistor operated in subthreshold region, the current components can also be implemented by using diode, BJT or diode turn-on NMOS (DTNMOS).

For simplicity, the description of the operation of the architectures in FIGS. 4-6 are omitted, and anyone skilled in the art would be aware of possible prior errors resulting due to a channel-length-modulation effect would be avoided according to the architectures in FIGS. 4-6 and the circuit principle described in FIG. 2.

In order to confirm the advantages of the present embodiment, several characteristic graphs shown in FIGS. 7-10 were obtained by simulation.

Figure 1:
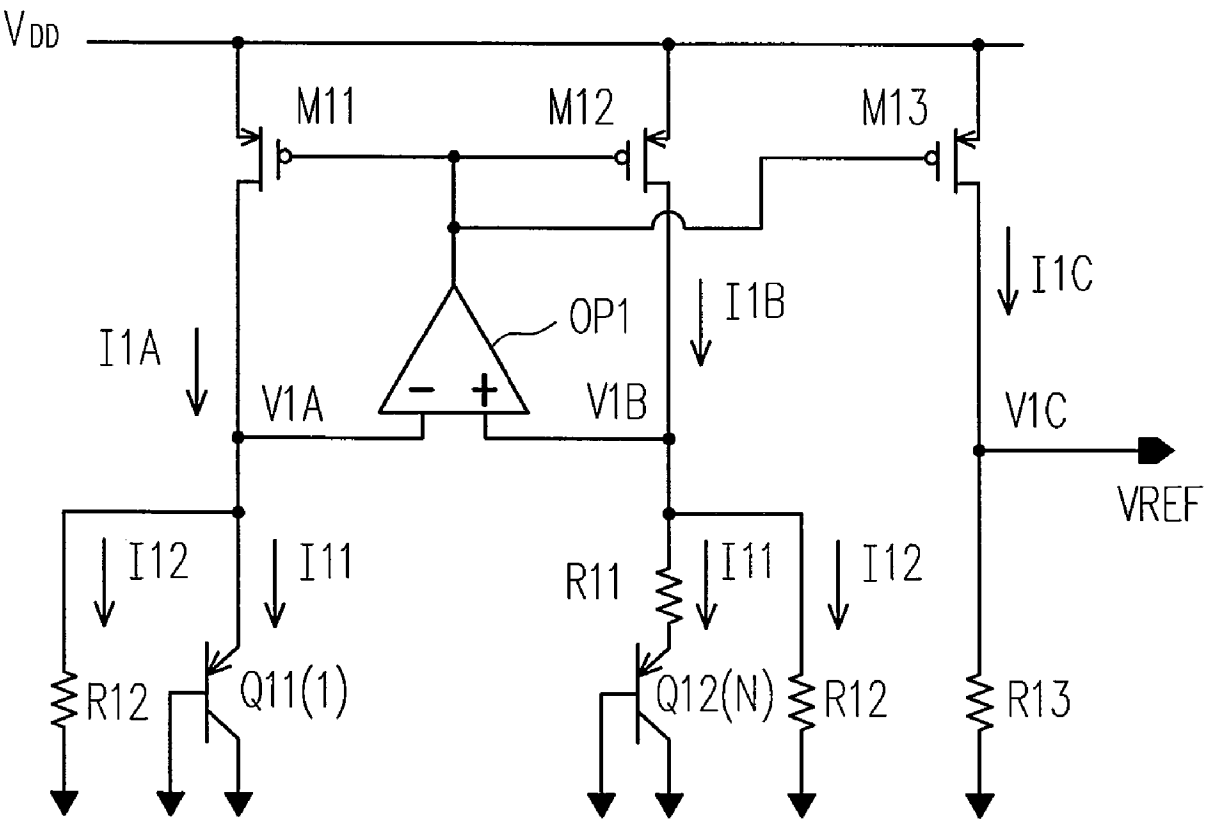
FIG. 1 (PRIOR ART)
FIG. 1 is a schematic diagram of a conventional bandgap reference circuit.
Figure 3:
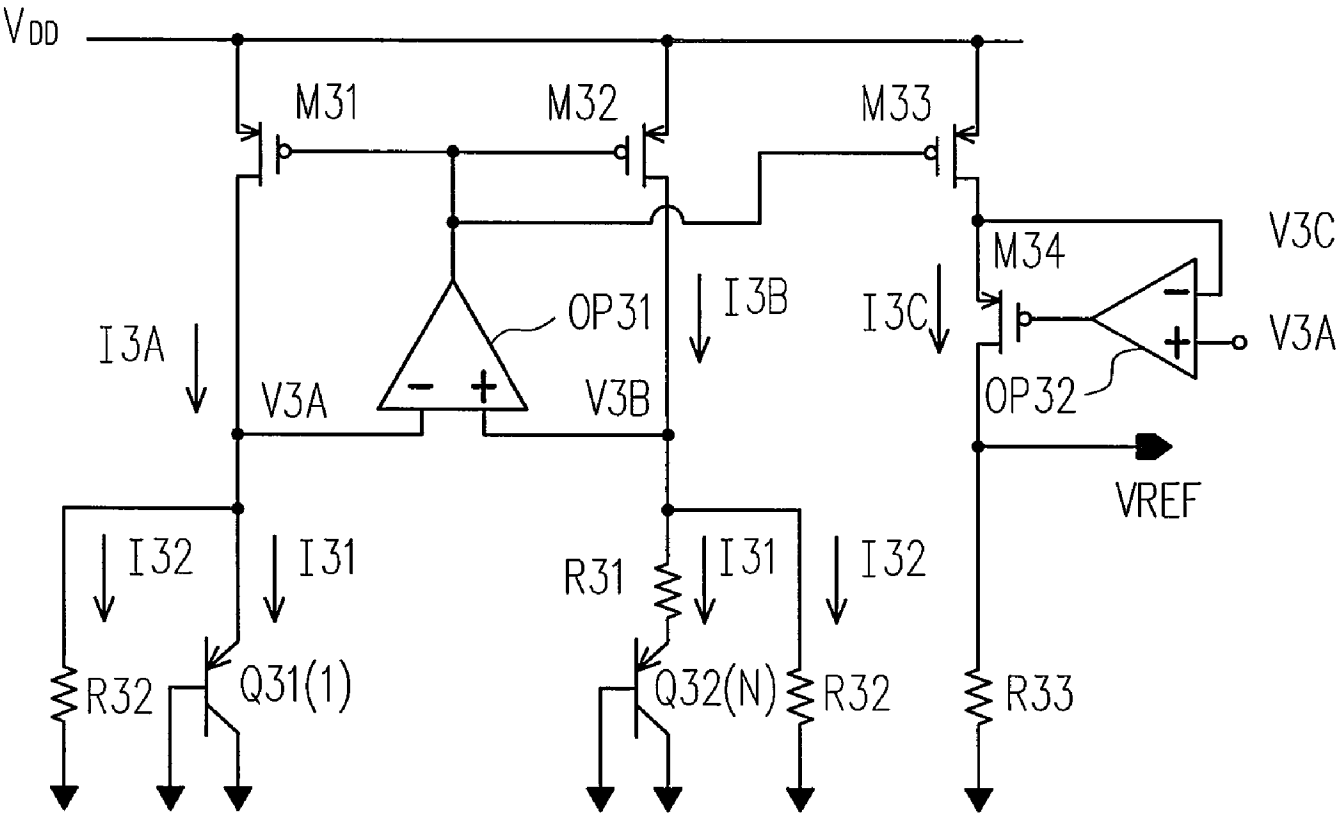
FIGS. 3-6 are several implementations of the embodiment of the present invention.
Figure 7B:
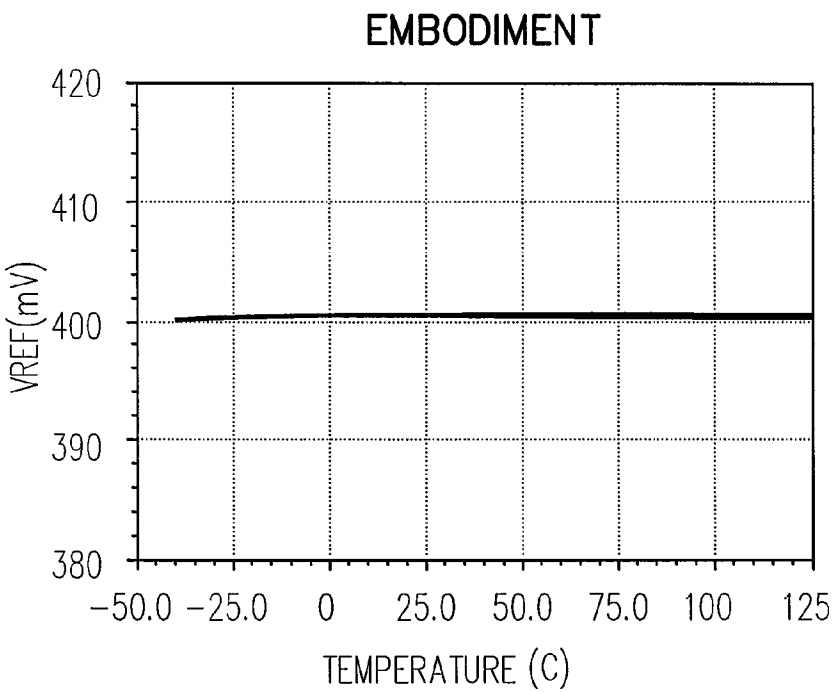
FIGS. 7*a* and 7*b* are curves showing the relationships of reference voltage VREF vs. temperature for the prior art (FIG. 1) and the present embodiment (FIG. 3).
Figure 7A:
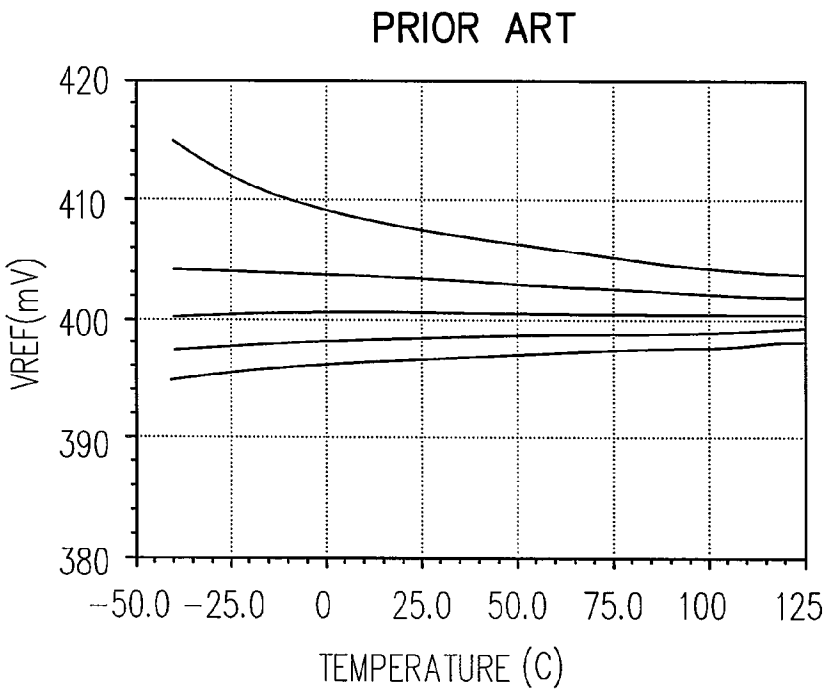

FIGS. 7*a* and 7*b* are curves showing the relationships of reference voltage VREF vs. temperature of the prior art (FIG. 1) and the present embodiment (FIG. 3). FIGS. 7*a* and 7*b* show five curves showing the relationship of different power source voltages, respectively ($V_{DD}$=1.0V, $V_{DD}$=1.1V, $V_{DD}$=1.2V, $V_{DD}$=1.3V and $V_{DD}$=1.4V). Since all the reference voltages under different power source voltages are very close to each other, the five curves in FIG. 7*b* may be difficult to be identified.

The temperature coefficients for the prior art (corresponding to FIG. 1) and the present embodiment (corresponding to FIG. 3) under different power source voltages are shown in the following table for comparison.

| | | Power Source Voltage (V) | | | | |
|---|---|---|---|---|---|---|
| | | 1 | 1.1 | 1.2 | 1.3 | 1.4 |
| Temperature Coefficient (ppm/K) | The Prior Art (FIG. 1) | 166.67 | 34.85 | 7.58 | 28.79 | 50.00 |
| | The Present Embodiment (FIG. 3) | 9.04 | 9.04 | 7.53 | 7.53 | 7.53 |

Figure 8A:
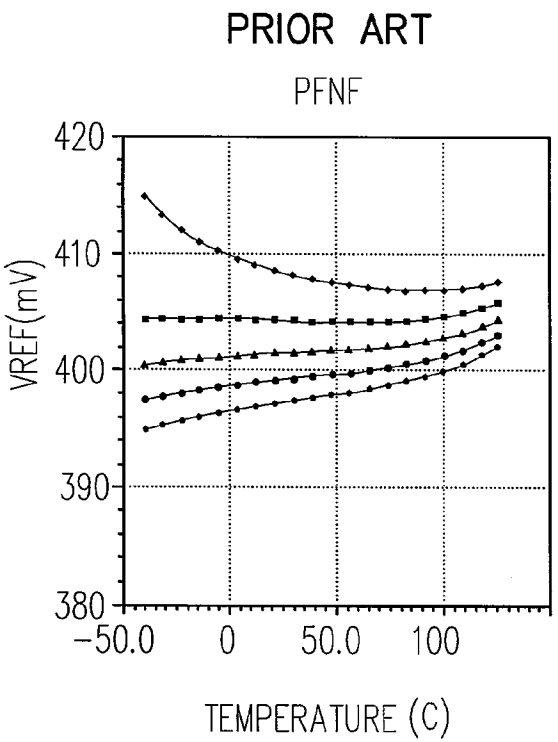
FIGS. 8*a*-8*f* are curve graphs showing the relationships of reference voltage VREF vs. temperature under different power source voltages for the prior art (FIG. 1) and the present embodiment (FIG. 3).
Figure 8B:
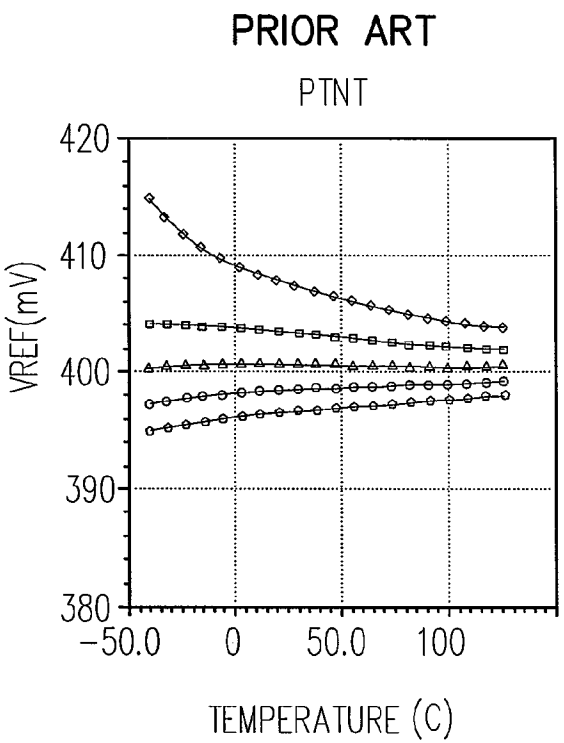
Figure 8C:
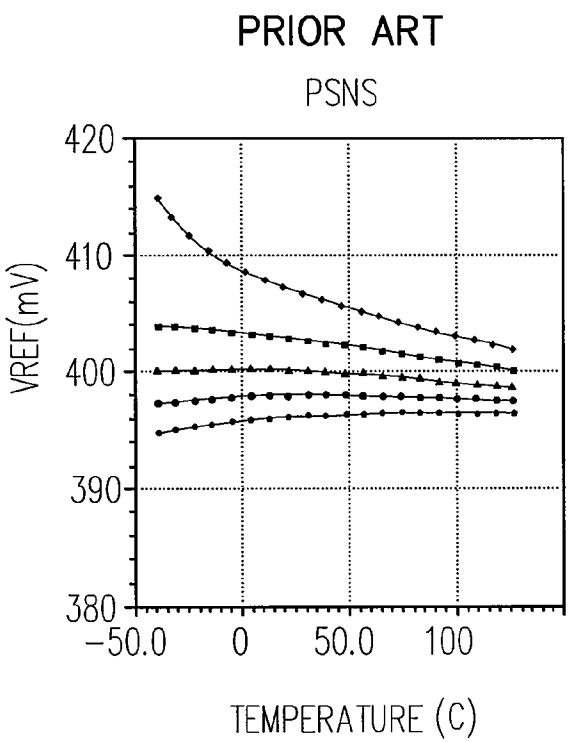
Figure 8D:
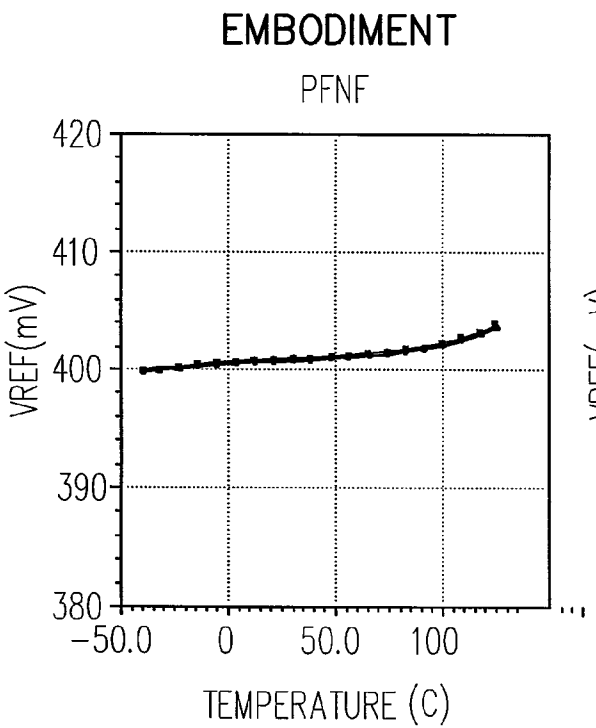
Figure 8E:
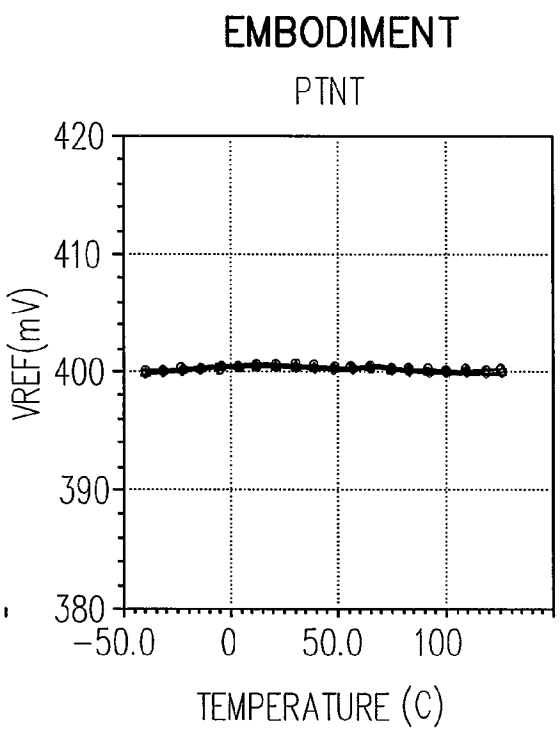
Figure 8F:
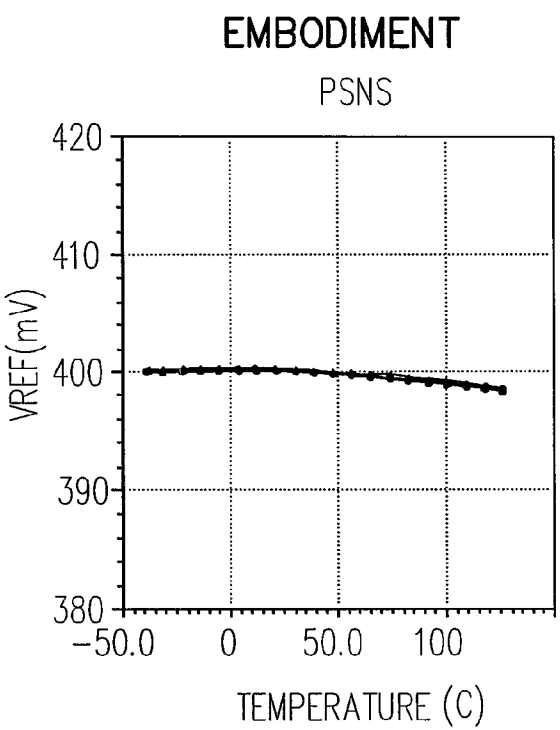

FIGS. 8*a* and 8*f* are curves showing the relationships of reference voltage VREF vs. temperature under different power source voltages for the prior art (FIG. 1) and the present embodiment (FIG. 3). In FIGS. 8*a*-8*f*, PFNF denotes PMOS fast NMOS fast, PTNT denotes PMOS typical NMOS typical and PSNS denotes PMOS slow NMOS slow, wherein PFNF, PTNT and PSNS are aware of by anyone skilled in the art and they are omitted to explain herein.

Similarly, FIGS. 8*a*-8*f* show five curves representing the relationship curves for different power source voltages, respectively ($V_{DD}$=1.0V, $V_{DD}$=1.1V, $V_{DD}$=1.2V, $V_{DD}$=1.3V and $V_{DD}$=1.4V). Since all the reference voltages under different power source voltages are very close to each other, the five curves in FIGS. 8*d*-8*f* may be difficult to be identified.

Figure 9B:
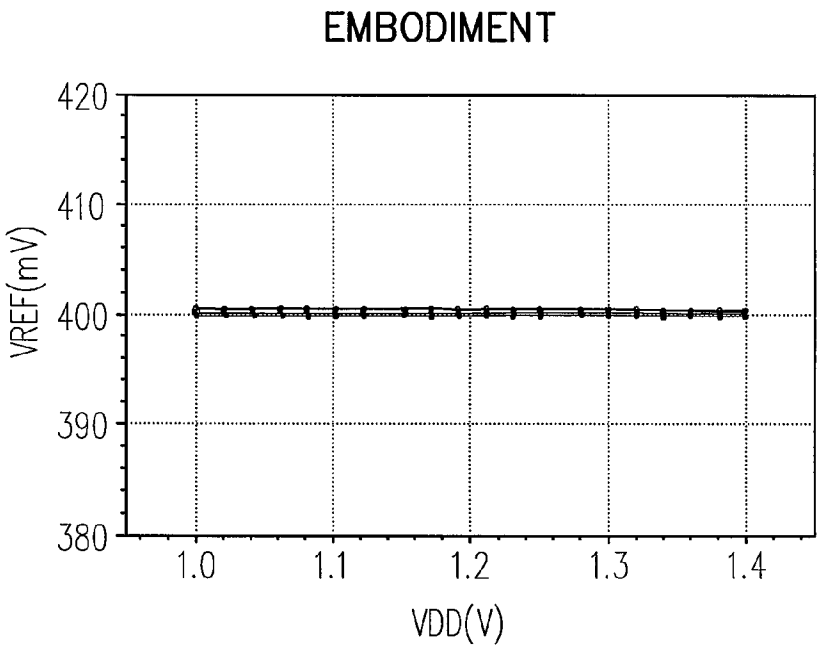
FIGS. 9*a* and 9*b* are curves showing the relationships of reference voltage VREF vs. voltage source's voltage for the prior art (FIG. 1) and the present embodiment (FIG. 3).
Figure 9A:
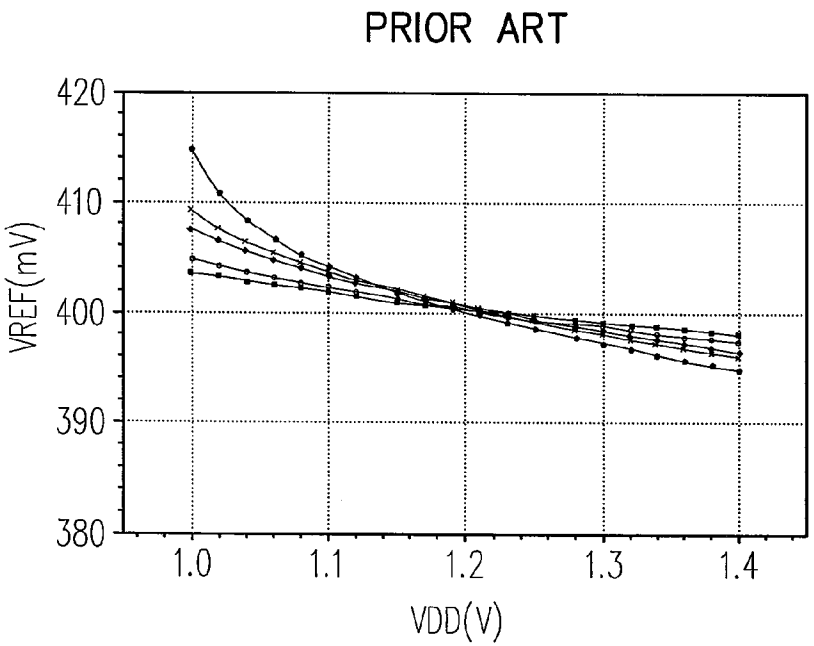
Figure 10A:
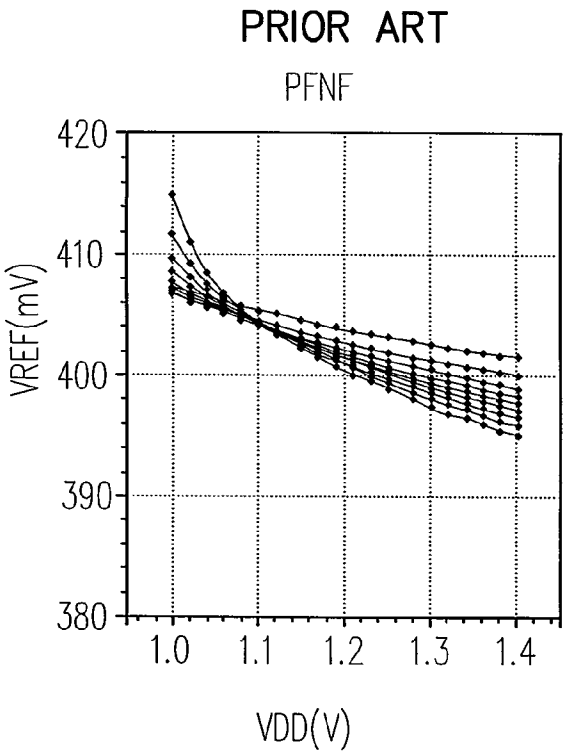
FIGS. 10*a*-10*f* are curves showing the relationships of reference voltage VREF vs. power source voltage under different simulation temperatures for the prior art (FIG. 1) and the present embodiment (FIG. 3).
Figure 10B:
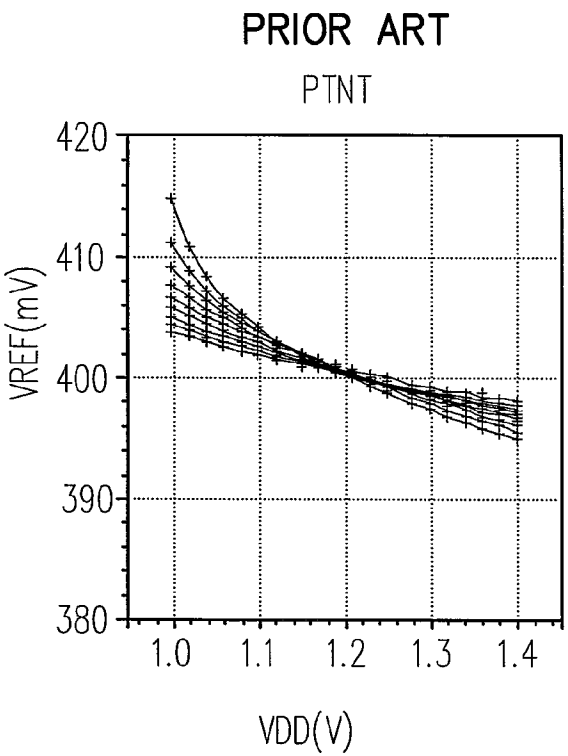
Figure 10C:
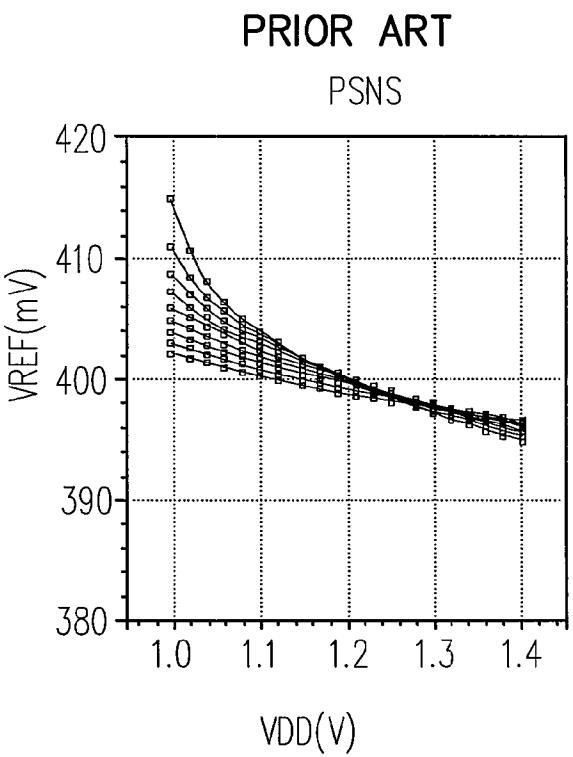
Figure 10D:
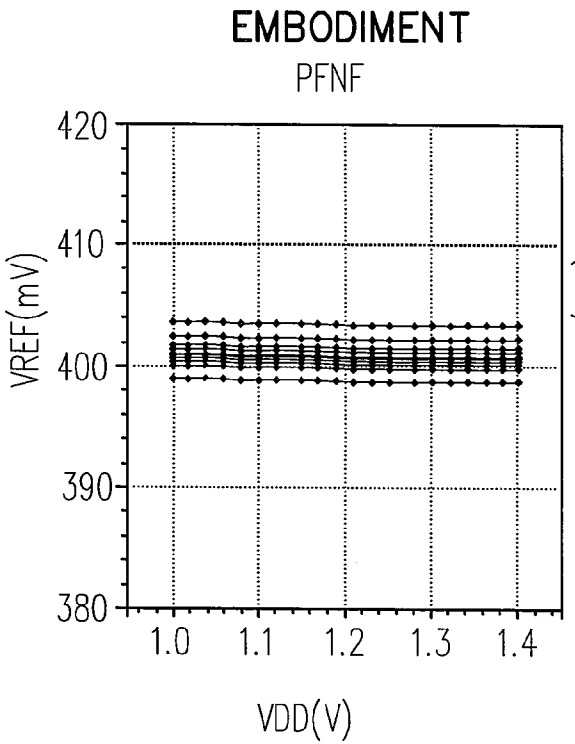
Figure 10E:
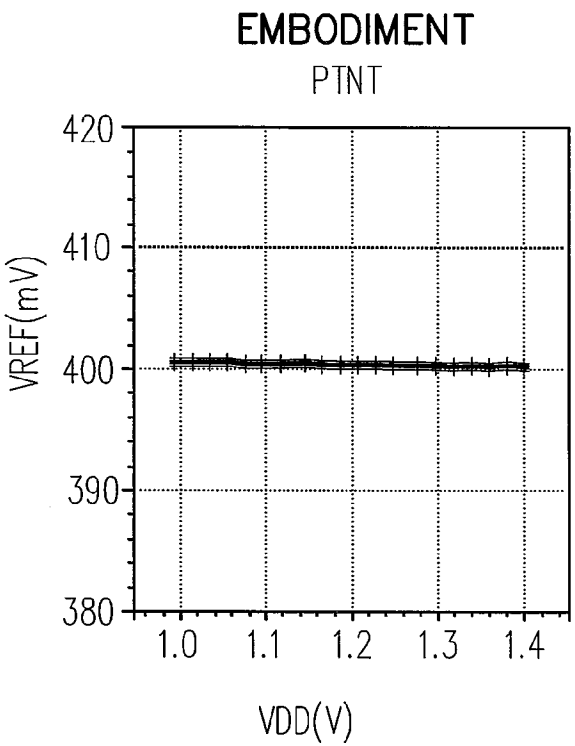
Figure 10F:
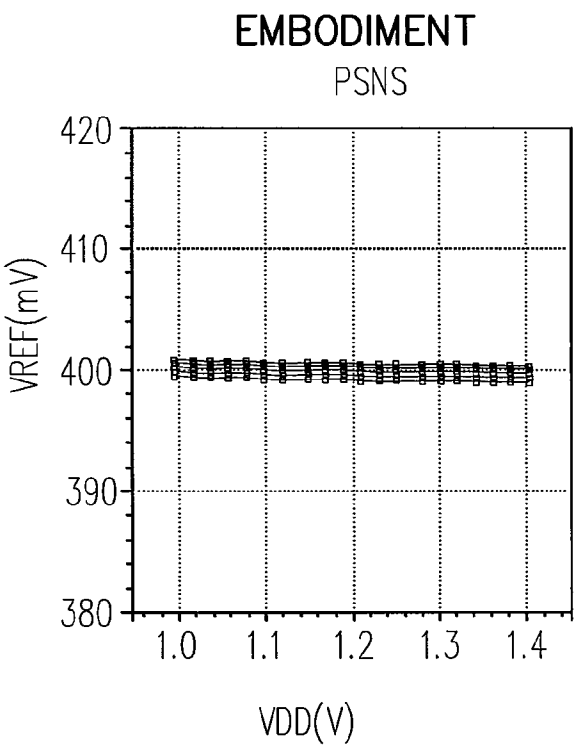

FIGS. 9*a* and 9*b* are curves showing the relationships of reference voltage VREF vs. temperature for the prior art (FIG. 1) and the present embodiment (FIG. 3). FIGS. 9*a* and 9*b* show five curves representing the relationship curves for different simulation temperatures, respectively (−40° C., 0° C., 25° C., 85° C. and 125° C.). Since all the reference voltages under different temperatures are very close to each other, the five curves in FIG. 9*b* may be difficult to be identified.

The PSRR coefficients for the prior art (corresponding to FIG. 1) and the present embodiment (corresponding to FIG. 3) under different temperatures are shown in the following table for comparison.

| | | Temperature (° C.) | | | | |
|---|---|---|---|---|---|---|
| | | −40 | 0 | 25 | 85 | 125 |
| PSRR (%/V) | The Prior Art (FIG. 1) | 12.44 | 8.19 | 6.81 | 4.63 | 3.44 |
| | The Present Embodiment (FIG. 3) | 0.06 | 0.09 | 0.19 | 0.22 | 0.26 |

FIGS. 10*a*~10*f* are curves showing the relationships of reference voltage VREF vs. power source voltages under different simulation temperatures for the prior art (FIG. 1) and the present embodiment (FIG. 3).

Similarly, FIGS. 10*a*-10*f* show five curves representing the relationship curves for different simulation temperatures, respectively (−40° C., 0° C., 25° C., 85° C. and 125° C.). Since all the reference voltages under different simulation temperatures are very close to each other, the five curves in FIGS. 10*d*-10*f* may be difficult to be identified.

According to the above described, advantages of the present embodiment rest in that, the novel bandgap reference circuit providing better temperature coefficients and PSRR characteristics, being operated by low voltage power source and having low dependency on temperature.

In addition, since another operation amplifier is employed to render the drain-source voltages of all the MOS transistors in the current mirror are substantially identical to each other, thus a circuit error caused by a channel-length-modulation effect can be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A bandgap reference circuit, comprising:

a reference current generator, for generating a first reference current on a first current path, and generating a third reference current on a third current path;

a current mirror, for generating a second reference current on a second current path according to the first reference current;

a feedback circuit, coupled to the first current path and the second current path to render a first node voltage on the first current path substantially identical to a second node voltage on the second current path; and a first operation amplifier having a positive input terminal coupled to the third current path, a negative input terminal coupled to the first current path and an output terminal coupled to the current mirror.

2. The bandgap reference circuit according to claim 1, further comprising a reference load coupled to the feedback circuit for providing a reference voltage.

3. The bandgap reference circuit according to claim 2, wherein the feedback circuit comprises a second operation amplifier and a first transistor.

4. The bandgap reference circuit according to claim 3, wherein the second operation amplifier has a positive input terminal coupled to the first current path, a negative input terminal coupled to the second current path and an output terminal coupled to the first transistor.

5. The bandgap reference circuit according to claim 4, wherein the first transistor has a source coupled to the second current path, a gate coupled to the output terminal of the second operation amplifier and a drain coupled to the reference load.

6. The bandgap reference circuit according to claim 1, wherein the reference current generator comprises:

at least a first current component, coupled to the first current path and capable of conducting current on the first current path; and at least a second current component, coupled to the second current path and capable of conducting current on the second current path, wherein each the first current component and each the current component can be a bipolar junction transistor, a diode, a MOS transistor operated in subthreshold region or a diode turn-on NMOS (DTNMOS).

7. A bandgap reference circuit, comprising:

a reference current generator, for respectively generating a first reference current on a first current path and generating a second reference current on a second current path;

a current mirror, for generating a third reference current on a third current path based on the first reference current and the second reference current;

a first operation amplifier, coupled to the first current path and the second current path to render a first node voltage on the first current path substantially identical to a second node voltage on the second current path; and a second operation amplifier, coupled to the first current path and the third current path to render the first node voltage substantially identical to a third node voltage on the third current path.

8. The bandgap reference circuit according to claim 7, wherein the first operation amplifier has a positive input terminal coupled to the second current path, a negative input terminal coupled to the first current path and an output terminal coupled to the current mirror.

9. The bandgap reference circuit according to claim 7, wherein the second operation amplifier has a positive input terminal coupled to the first current path, a negative input terminal coupled to the third current path and an output terminal.

10. The bandgap reference circuit according to claim 9, further comprising a first transistor having a source coupled to the third current path, a gate coupled to the output terminal of the second operation amplifier and a drain.

11. The bandgap reference circuit according to claim 10, further comprising a reference load coupled to a drain of the first transistor.

12. The bandgap reference circuit according to claim 7, wherein the reference current generator comprises:

at least a first current component, coupled to the first current path and capable of conducting current on the first current path; and at least a second current component, coupled to the second current path and capable of conducting current on the second current path, wherein each the first current component and each the current component can be a bipolar junction transistor, a diode, a MOS transistor operated in subthreshold region or a diode turn-on NMOS (DTNMOS).

13. A bandgap reference circuit, comprising:

a reference current generator, for respectively generating a first reference current on a first current path and generating a second reference current on a second current path;

a current mirror, for generating a third reference current on a third current path based on the first reference current and the second reference current;

a first operation amplifier, coupled to the first current path and the second current path to render a first node voltage on the first current path substantially identical to a second node voltage on the second current path; and a feedback circuit, coupled to the first current path and the third current path to render the first node voltage substantially identical to a third node voltage on a third current path; and a reference load, coupled to the feedback circuit to provide a reference voltage.

14. The bandgap reference circuit according to claim 13, wherein the first operation amplifier has a positive input terminal coupled to the second current path, a negative input terminal coupled to the first current path and an output terminal coupled to the current minor.

15. The bandgap reference circuit according to claim 13, wherein the feedback circuit comprises a second operation amplifier and a first transistor.

16. The bandgap reference circuit according to claim 15, wherein the second operation amplifier has a positive input terminal coupled to the first current path, a negative input terminal coupled to the third current path and an output terminal coupled to the first transistor.

17. The bandgap reference circuit according to claim 16, wherein the first transistor has a source coupled to the third current path, a gate coupled to the output terminal of the second operation amplifier and a drain coupled to the reference load.

18. The bandgap reference circuit according to claim 13, wherein the reference current generator comprises:

at least a first current component, coupled to the first current path and capable of conducting current on the first current path; and at least a second current component, coupled to the second current path and capable of conducting current on the second current path, wherein each the first current component and each the current component can be a bipolar junction transistor, a diode, a MOS transistor operated in subthreshold region or a diode turn-on NMOS (DTNMOS).

* * * * *